US007318305B2

(12) United States Patent
Reiche

(10) Patent No.: US 7,318,305 B2
(45) Date of Patent: Jan. 15, 2008

(54) PACKING MACHINE AND FILM BUFFER

(75) Inventor: Udo Reiche, Bornheim (DE)

(73) Assignee: Cyclop GmbH, Cologne (DE)

( * ) Notice: Subject to any disclaimer, the term of this patent is extended or adjusted under 35 U.S.C. 154(b) by 65 days.

(21) Appl. No.: 10/484,177

(22) PCT Filed: May 22, 2002

(86) PCT No.: PCT/EP02/05583

§ 371 (c)(1),
(2), (4) Date: Jul. 2, 2004

(87) PCT Pub. No.: WO03/008268

PCT Pub. Date: Jan. 30, 2003

(65) Prior Publication Data

US 2004/0231289 A1 Nov. 25, 2004

(30) Foreign Application Priority Data

Jul. 18, 2001 (DE) ..... 101 34 258

(51) Int. Cl.
*B65B 41/00* (2006.01)

(52) U.S. Cl. ..... 53/389.3; 53/590; 53/593; 53/389.5

(58) Field of Classification Search ..... 53/389.3, 53/589, 590, 399, 593, 389.4, 389.5
See application file for complete search history.

(56) References Cited

U.S. PATENT DOCUMENTS 2,346,194 A 4/1944 Sjostrom
2,931,148 A * 4/1960 Smith ..... 53/450
3,078,023 A 2/1963 Hecker
3,470,814 A * 10/1969 Tschappu ..... 100/4
3,504,476 A * 4/1970 Ehrenfried et al. ..... 53/397
3,508,378 A * 4/1970 Ashcraft et al. ..... 53/553
3,513,622 A * 5/1970 Timmerbeil ..... 53/493
3,518,806 A * 7/1970 Arsenault et al. ..... 53/493
3,611,028 A 10/1971 Whitmore
3,672,116 A * 6/1972 Ingmarson ..... 53/397
3,757,164 A 9/1973 Binkowski
3,899,864 A * 8/1975 Uchida et al. ..... 53/212
4,075,815 A * 2/1978 Carver et al. ..... 53/463

(Continued)

FOREIGN PATENT DOCUMENTS

DE 7218370 9/1972

(Continued)

*Primary Examiner*—Sameh H. Tawfik
(74) *Attorney, Agent, or Firm*—Fay Sharpe LLP; Brian E. Turung

(57) ABSTRACT

A packaging machine for wrapping packing pieces with packing film. The packing machine includes a transport device for the packing pieces, at least one unspooling device for unspooling the packing film wound on a roller, a film welding and cutting unit, and a film buffer arranged between the film welding and cutting unit and the unspooling device. The film support is formed of a flexible, anti-static material which ensures particularly easy pulling off of the packing film from the film buffer. The film support inhibits or prevents the plastic film from incurring a static charge, thereby reducing or eliminating adhesion forces would have to be overcome as a result of electrostatic charges when pulling the plastic film off of the film buffer.

48 Claims, 2 Drawing Sheets

U.S. PATENT DOCUMENTS

| | | | | | |
|---|---|---|---|---|---|
| 4,085,879 | A | * | 4/1978 | Nobuhiro | 225/93 |
| 4,137,788 | A | * | 2/1979 | Fischer | 100/4 |
| 4,319,443 | A | | 3/1982 | Watts | |
| 4,484,926 | A | | 11/1984 | Atlas | |
| 4,554,775 | A | * | 11/1985 | Asami et al. | 53/64 |
| 4,641,771 | A | | 2/1987 | Masuch | |
| 4,691,498 | A | * | 9/1987 | Stamm | 53/399 |
| 4,938,009 | A | * | 7/1990 | Takami | 53/589 |
| 5,189,865 | A | | 3/1993 | Andrade | |
| 5,236,329 | A | * | 8/1993 | Sylvester | 53/399 |
| 5,299,407 | A | * | 4/1994 | Schuttler et al. | 53/399 |
| 5,333,438 | A | * | 8/1994 | Gurak et al. | 53/399 |
| 5,456,792 | A | * | 10/1995 | Rodriguez et al. | 156/577 |
| 5,534,192 | A | | 7/1996 | Incorvia | |
| 5,775,623 | A | | 7/1998 | Long | |
| 5,981,066 | A | | 11/1999 | Gabbay | |
| 6,223,500 | B1 | | 5/2001 | Kramps | |
| 6,546,696 | B2 | * | 4/2003 | Cranston et al. | 53/399 |

FOREIGN PATENT DOCUMENTS

| | | |
|---|---|---|
| DE | 3509329 | 10/1985 |
| JP | 60 112557 | 6/1985 |
| JP | 60112557 A | 6/1985 |
| JP | 08 119214 | 5/1996 |
| JP | 08119214 A | 5/1996 |
| JP | 10 297616 | 11/1998 |
| JP | 10297616 A | 11/1998 |

* cited by examiner

PACKING MACHINE AND FILM BUFFER

The present invention claims priority on co-pending International Patent Publication No. WO 03/008268 filed on May 22, 2002, which in turn claims priority on German Patent Application Serial No. 101 34 258.6 filed on Jul. 18, 2001.

The present invention relates to a packaging machine for the wrapping of packing pieces with packing film. The present invention is more particularly related to a packaging machine having a transport device for the packing pieces, at least one unspooling device for unspooling the packing film wound on a roller, a packing film cutting and connecting device, and a buffer located between the unspooling device and the packing film cutting and connecting device.

BACKGROUND OF THE INVENTION

Packaging machines for the wrapping of packing pieces with plastic film are often used for the packing of newspapers and magazines. The newspapers and magazines are typically guided through the transport channel by means of the transport device in packs of different heights or as a single copy. The newspapers and magazines are wrapped in the machine by plastic film.

The plastic film is generally pulled from two rolls, one of which is arranged below the transport device, and the other one above. The plastic films are welded or connected approximately at the height of the transport device. As a result, the plastic films form a closed web or film wall running transversely to the transport direction of the packing pieces (e.g., newspapers and magazines). The plastic film from the lower roll applies itself from below and between the transport device as the packing pieces move against the plastic film from the lower roll. The upper roller guides the plastic film to be deposited around the front face and the upper side of the packing pieces. The wrapped packing pieces are then guided to the transport device with the help of the film cutting and welding or connecting unit descending from above in the direction of the transport band. The plastic film from the upper roller is welded or connected to the plastic film from the lower roller by two parallel weld seams and the plastic films are then cut between the two weld seams. The packing piece which is wrapped in such a manner with a circulating film tube at its front and back face, and its upper and lower side, is subsequently ejected by the transport device.

During the packing process, it is particularly important when wrapping flexible packing pieces (e.g., single newspapers, magazines etc.) that the film piece supplied from above is wrapped around the packing piece essentially without any tension. If the-plastic film is wrapped with tension around a flexible packing piece, the flexible packing piece can be damaged by the tension force in the plastic. For instance, a single newspaper will be bent or partially rolled up during the wrapping process. Prior art wrapping systems that pull plastic film off a roll of film do not do not allow a tension-relieved wrapping of the packing piece, thus result in damage to the flexible packing piece.

Some prior art packing systems have incorporated a buffer device to address the damage issue to flexible packing pieces. These prior art buffer devices consist of elaborate mechanical arrangements that incorporate the use of a plurality of deflection rollers, of which one or more of the rollers are arranged to be moveable in such a manner that their center distance can freely adjust to the fixed rollers. Even with such a prior art buffer device, the weight and inertia forces of the deflection rollers have to be overcome during the pulling of the plastic film. As a result, the plastic film is not wrapped around the flexible packing piece in a tension-free manner. When using these prior art buffer arrangements, it has been found that the plastic film tends to charge itself statically as the plastic film passes over the plurality of deflection around rollers. The statically charged plastic film has a tendency to adhere to neighboring surfaces, whereby the adhesion forces arising from the static charge can be considerable and can even lead to stretching of the plastic film. The same phenomenon was found to occur when the film buffer was formed as a film tray made of a tin box or the like, into which the plastic film was deposited after being pulled off from the roll of plastic film.

In view of the present state of technology which respect to wrapping machines, there is a demand for a plastic wrapping machine that reliably and efficiently wraps packing pieces and reduces or prevents damage to flexible packing pieces during the wrapping process and reduces the build-up of a static charge on the plastic film.

SUMMARY OF THE INVENTION

In accordance with the present invention, there is provided a packaging machine that is design to wrap packing pieces with packing film. The packing film is typically a plastic film such as polyethylene (e.g., LDPE, LLDPE, MDPE, HDPE, etc.); however, other types of packing films can be used. The packing machine is designed to provide a film buffer that reduces the tension of the plastic film during a packing process, thereby reducing or preventing damage to flexible packing pieces when wrapping such pieces with a plastic film. The packing machine includes a transport device for the packing pieces that are arranged in a transport channel. The packing machine also includes at least one unspooling device for unspooling packing film that is wound on a roller which supports a roll of packing film. The packing machine further includes a packing film cutting and a packing film connecting or welding device. The welding device is designed to pull one packing film section from at least one of the pulling devices and to weld or connect the one packing film section to another packing film section that is forming a packing film tube which surrounds the packing piece. The packing machine also includes a film buffer arranged between the film welding and cutting device and the unspooling device.

In one aspect of the present invention, there is provided a packing machine that incorporates the use of a film buffer that comprises a film support that includes a flexible anti-static material. The use of a film buffer that includes or is made from an anti-static material has the advantage that the packing film that is positioned on the film buffer does not incur a static charge, thus does not adhere to the film buffer or other portions of the packing machine. The plastic film, when not having a static charge, lies entirely free on the film support and can be pulled off the film support with a small amount of effort. As a result, the plastic film can be wrapped securely loose around flexible packing pieces so that these flexible packing pieces are not damaged during the packaging process (e.g., bent, rolled up, etc.). In one embodiment of the invention, the film support includes a fabric and/or a non-woven material of anti-static threads of fibers. In one aspect of this embodiment, the flexible anti-static material includes a linen cloth.

In another and/or alternative aspect of the present invention, there is provided a packing machine that incorporates a film buffer that comprises a film support that can be secured with clamping ledges to the packing machine. In one embodiment of the invention, the film support is secured with clamping ledges at the front and/or rear ends of the film support such that the plastic film can move or flow from the front to the rear end of the film support. In another and/or alternative embodiment of the invention, the clamping ledges can be arranged on the packing machine frame, on the unspooling device, on the film cutting and welding unit and/or at another suitable location on the packing machine.

In yet another and/or alternative aspect of the present invention, there is provided a packing machine that incorporates a film buffer that comprises a film support that is at least partially arranged in a sagging manner. In one embodiment of the invention, the film support is arranged such that a majority or gross of the buffered plastic film gathers approximately in the center region of the film support.

In yet another and/or alternative aspect of the present invention, there is provided a packing machine that incorporates an unspooling device that includes a film pull-off chute that discharges plastic film above the film support such that the plastic film that is unwound from the roller falls onto the film support and thereby deposits itself generally in waves or loops on the film support.

In summary, there is provided a packaging machine for wrapping packing pieces with packing film. The packing machine includes a transport device for the packing pieces, at least one unspooling device for unspooling packing film wound onto a roller, a film welding and cutting unit, and a film buffer arranged between the film welding and cutting unit and the unspooling device. The film support typically includes a flexible anti-static material. The film support is typically made of a fabric or a non-woven material of anti-static threads or fibers. In one non-limiting design, the film support is linen cloth. The film support can be secured with clamping ledges at the front and/or back end of the film support in the flow direction of the plastic film. The film support is typically arranged in a sagging manner. The packing machine typically includes an unspooling device that includes a film pull-off chute that dispenses the plastic film above the film support.

It is an object of the invention to provide a packing machine that reliably and efficiently wraps packing pieces and reduces or prevents damage to flexible packing pieces during the wrapping process.

It is another and/or alternative object of the invention to provide a packing machine that reduces the build-up of a static charge on the plastic film during the packing process.

It is still another and/or alternative object of the invention to provide a packing machine that includes a film buffer from which plastic packing film can be pulled off with very small effort.

It is yet another and/or alternative object of the invention to provide a packing machine that includes a film support at least partially formed of flexible anti-static material.

It is still yet another and/or alternative object of the invention to provide a packing machine that includes a film support that can be easily clamped or otherwise secured to the packing machine.

It is a further and/or alternative object of the invention to provide a packing machine that includes a film support that is at least partially arranged in a sagging manner.

It is still a further and/or alternative object of the invention to provide a packing machine that includes an unspooling device that discharges plastic film in waves or loops onto the film support.

These and other objects and advantages will become apparent from the discussion of the distinction between the invention and the prior art and when considering the preferred embodiment as shown in the accompanying drawings.

BRIEF DESCRIPTION OF THE INVENTION

Figure 1:
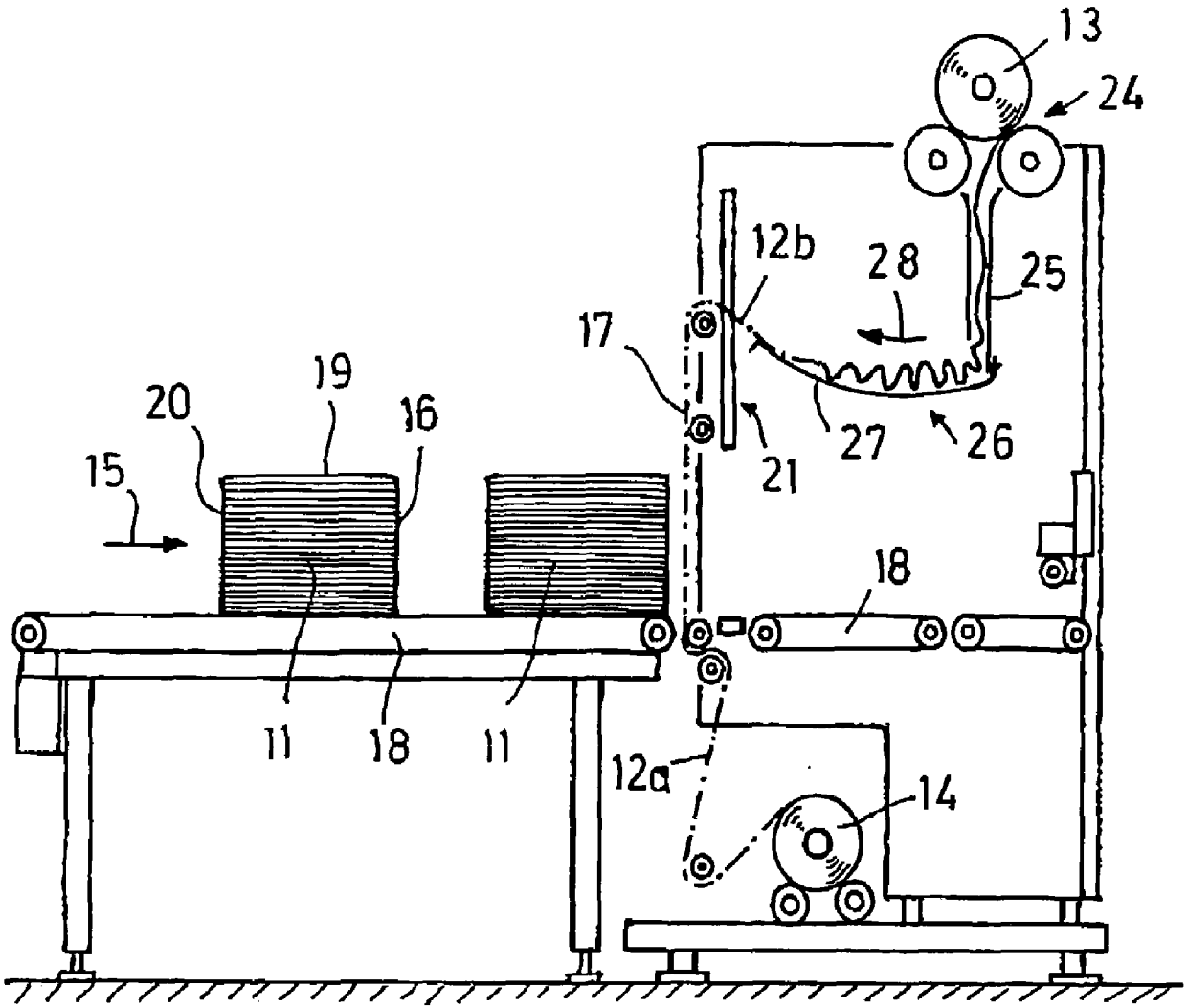
FIG. 1 is a side elevation view of a packaging machine in accordance with the invention; and, FIG. 2 is an enlarged schematic view of a portion of the packing machine of FIG. 1.
Figure 2:
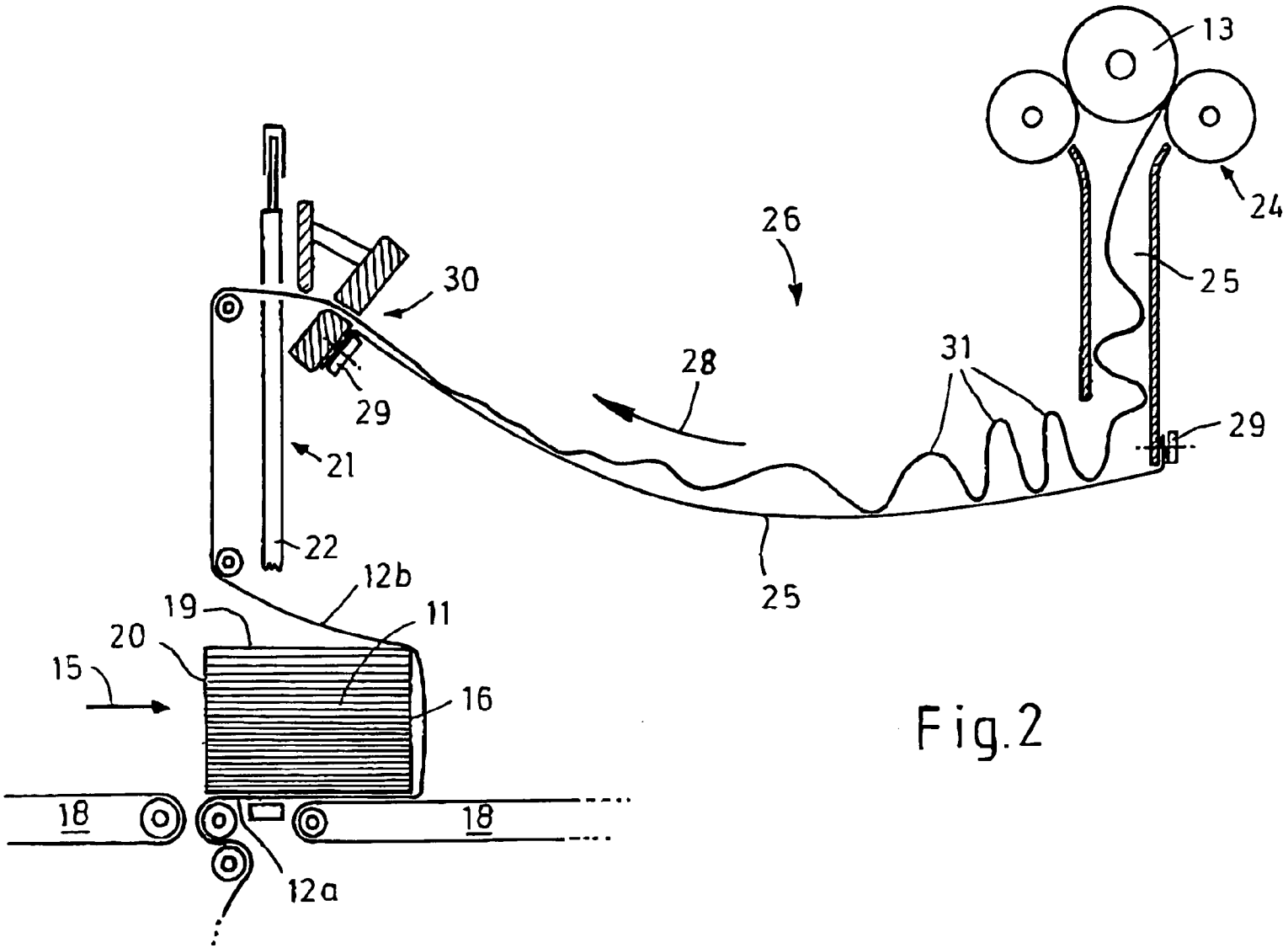

Referring now in greater detail to the drawings, wherein the showings are for the purpose of illustrating preferred embodiments of the invention only, and not for the purpose of limiting the invention, FIG. 1 illustrates a packaging machine designated as 10 in its entirety in the pulling serves for wrapping newspaper packs 11 with a packing film 12, so that the newspapers are protected from water and dirt during their further transport. The packing machine will be described in detail with respect to the wrapping of newspapers; however, it will be appreciated that other materials can be wrapped by the packing machine of the present invention.

The packing film, which is typically a plastic wrapping film, is pulled from an upper roll 13 and a lower roll 14 in two sections 12*a*, 12*b* in an essentially known manner, whereby the film sections 12*a, b* are connected to one another after diverse deflections in the machine frame to a clamped film wall 17 running generally transversely to the transport direction 15 of the packing pieces 11 in front of the front face 16. The newspaper packs 11 to be packed lie on a transport band 18 and run with face 16 against the film wall 17 during their transport, so that the film section 12*a* supplied from below deposits itself between the transport band 18 and the lower side of the pack 11, while the film section supplied from above covers the front face 16, the upper side 19 and the rear face 20 of the newspaper pack 11.

So as to also cover the backside face 20 with film, and to create hereby a closed film tube surrounding the pack at its four sides, the machine is provided with a film cutting and welding unit 21 which comprises a welding knife 22 which is moveable in a vertical direction in the machine frame. After a newspaper pack has passed under the welding knife, the knife is moved downwardly in the direction of the transport band and thereby takes along the upper film section 12*b* so as to weld it to the lower film section 12*a* with two parallel weld seams and to separate the two sections between the weld seams, so that the complete wrapped packing piece can be transported further and a new film wall 17 develops in front of the next packing piece. The welding and/or cutting process can be fully mechanical or can include the use of heat.

During the wrapping of the packing pieces with the plastic film, it is desirable that the film piece 12*b*, which is supplied from above, is deposited with little or no tension around the newspapers. The plastic film, which is wound on roller 13, is positioned above the film buffer. The plastic film is unwound from roller 13 by a unspooling device 24 which is also positioned above the film buffer. The unspooling device includes a film pull-off chute 25 which guides the plastic film that is unrolled from roller 13 onto the film buffer 26. The plastic film on the film buffer can be pulled off the film buffer with very little force.

The film buffer 26 consists essentially of a flexible anti-static film support 27 that is made of linen cloth. The film support is secured at its front and rear end with clamping ledges 29 in the flow direction 28. The film from end is clamped to the pull-off chute 25 and the rear end is clamped to a guide device 30. The film support is clamped in such a manner that it sags downwardly in a bellied manner. The linen cloth reliably inhibits or prevents a static charge from forming on the plastic film as the plastic film is deposited thereon in waves or loops 31. As such, the plastic film, with little or no anti-static charge, does not adhere to the film support, thus little or no adhesion forces have to be overcome during the pulling of the plastic film off of the film buffer.

The packing pieces 11 which are moved along by the transport band 18 below the welding and cutting unit thereby pull off the film section 12*b* supplied from above reliably without the result that the newspapers of the newspaper pack are damaged due to a film tension which is too high. As a result, the bending of the upper newspaper, displacing of the newspaper pack or the rolling up of newspapers which are packed individually is reduce or avoided.

The invention is not limited to the shown and described example of an embodiment, but several changes are conceivable without leaving the scope of the invention. It is possible without any problems to assign a film buffer according to the invention to the film section supplied from below, if this is useful in an individual case. Instead of linen, other materials can be considered for the film support of the buffer, which materials reduce or prevent static charging of the plastic film or deflect it reliably. For example, the use of (grounded) carbon fiber mats or the like are conceivable alternatives to linen.

The invention claimed is:

1. A packaging machine for wrapping packing pieces with packing film comprising a transport device for the packing pieces, at least one unspooling device for unspooling the packing film that is wound onto a roller, a film welding and cutting unit, and a film buffer positioned between the film welding and cutting unit and the unspooling device and designed to control run-up of packing film into the transport channel during the wrapping of said packing pieces, said film buffer including a first and second ends, said film buffer designed to at least partially support a length of said packing film that accumulates in waves and/or loops between said first and second ends of said film buffer and said at least one unspooling device and said film welding and cutting unit, said film buffer including a film support formed at least partially of a flexible anti-static material that inhibits said packing film from adhering to said anti-static material as said packing film moves along a surface of said anti-static material, said packing film designed to cover at least one side of the packing pieces.

2. The packaging machine as defined in claim 1, wherein said film support includes a fabric or a non-woven material of anti-static threads or fibers.

3. The packaging machine as defined in claim 2, wherein said film support includes linen cloth.

4. The packaging machine as defined in claim 3, wherein said film support is at least partially secured with clamping ledges at the front end, back end or combinations thereof such that the front and back ends of said film support lie in a flow direction of said packing film, said film support is non-planar when at least partially secured with said clamping ledges.

5. The packaging machine as defined in claim 4, wherein said film support is arranged in a sagging manner.

6. The packaging machine as defined in claim 5, wherein said unspooling device includes a film pull-off chute that directs the packing film downwardly from said roller onto said film support.

7. The packaging machine as defined in claim 6, wherein said film welding and cutting unit is designed to at least partially cut the packing film at a wrapping location and to at least partially weld said packing film together after said packing film has been at least partially wrapped about one of said packing pieces.

8. The packaging machine as defined in claim 7, wherein said packing film is formed a material that enables said packing film to be wrapped about the packing pieces with little or no tension applied to the packing pieces.

9. The packaging machine as defined in claim 2, wherein said film support is at least partially secured with clamping ledges at the front end, back end or combinations thereof such that the front and back ends of said film support lie in a flow direction of said packing film, said film support is non-planar when at least partially secured with said clamping ledges.

10. The packaging machine as defined in claim 9, wherein said film support is arranged in a sagging manner.

11. The packaging machine as defined in claim 10, wherein said unspooling device includes a film pull-off chute that directs the packing film downwardly from said roller onto said film support.

12. The packaging machine as defined in claim 2, wherein said film support is arranged in a sagging manner.

13. The packaging machine as defined in claim 2, wherein said unspooling device includes a film pull-off chute that directs the packing film downwardly from said roller onto said film support.

14. The packaging machine as defined in claim 1, wherein said film support includes linen cloth.

15. The packaging machine as defined in claim 14, wherein said film support is at least partially secured with clamping ledges at the front end, back end or combinations thereof such that the front and back ends of said film support lie in a flow direction of said packing film, said film support is non-planar when at least partially secured with said clamping ledges.

16. The packaging machine as defined in claim 15, wherein said film support is arranged in a sagging manner.

17. The packaging machine as defined in claim 16, wherein said unspooling device includes a film pull-off chute that directs the packing film downwardly from said roller onto said film support.

18. The packaging machine as defined in claim 14, wherein said film support is arranged in a sagging manner.

19. The packaging machine as defined in claim 14, wherein said unspooling device includes a film pull-off chute that directs the packing film downwardly from said roller onto said film support.

20. The packaging machine as defined in claim 1, wherein said film support is at least partially secured with clamping ledges at the front end, back end or combinations thereof such that the front and back ends of said film support lie in a flow direction of said packing film, said film support is non-planar when at least partially secured with said clamping ledges.

21. The packaging machine as defined in claim 20, wherein said film support is arranged in a sagging manner.

22. The packaging machine as defined in claim 21, wherein said unspooling device includes a film pull-off chute that directs the packing film downwardly from said roller onto said film support.

23. The packaging machine as defined in claim 20, wherein said unspooling device includes a film pull-off chute that directs the packing film downwardly from said roller onto said film support.

24. The packaging machine as defined in claim 1, wherein said film support is arranged in a sagging manner.

25. The packaging machine as defined in claim 24, wherein said unspooling device includes a film pull-off chute that directs the packing film downwardly from said roller onto said film support.

26. The packaging machine as defined in claim 1, wherein said unspooling device includes a film pull-off chute that directs the packing film downwardly from said roller onto said film support.

27. The packaging machine as defined in claim 1, wherein said film welding and cutting unit is designed to at least partially cut the packing film at a wrapping location and to at least partially weld said packing film together after said packing film has been at least partially wrapped about one of said packing pieces.

28. The packaging machine as defined in claim 1, wherein said packing film is formed a material that enables said packing film to be wrapped about the packing pieces with little or no tension applied to the packing pieces.

29. A packaging machine for wrapping packing pieces which packaging machine controls run-up of packing film into a transport channel during the wrapping of said packing pieces with said packing film, said packaging machine comprising an upper packing film delivery arrangement, a film cutting and welding device to at least partially cut said packing film at a wrapping location and to at least partially weld said packing film together after said packing film has been at least partially wrapped about one of said packing pieces, said upper packing film delivery arrangement including at least one source of packing film and at least one guide arrangement to guide said packing film to said wrapping location, said upper packing film delivery arrangement including a packing film buffer wherein said packing film moves from a first end to a second end of said packing film buffer as said packing films moves from said source of packing film to said wrapping location, said packing film buffer designed to at least partially support said packing film that has accumulated between said second end and said first end, said packing film buffer at least partially formed of a flexible antistatic material that inhibits said packing film from adhering to said anti-static material as said packing film moves on said anti-static material, said packing film designed to cover at least one side of the packing pieces.

30. The packaging machine as defined in claim 29, wherein said packing film buffer includes linen cloth.

31. The packaging machine as defined in claim 30, wherein said packing film buffer is non-planar.

32. The packaging machine as defined in claim 31, wherein said upper packing film delivery arrangement includes a chute that guides said packing film as said packing film substantially freely moves downwardly from said source of packing film onto said packing film buffer.

33. The packaging machine as defined in claim 30, wherein said upper packing film delivery arrangement includes a chute that guides said packing film as said packing film substantially freely moves downwardly from said source of packing film onto said packing film buffer.

34. The packaging machine as defined in claim 29, wherein said packing film buffer is non-planar.

35. The packaging machine as defined in claim 29, wherein said upper packing film delivery arrangement includes a chute that guides said packing film as said packing film substantially freely moves downwardly from said source of packing film onto said packing film buffer.

36. A packaging machine for wrapping packing pieces which packaging machine controls run-up of packing film into a transport channel during the wrapping of said packing pieces with said packing film, said packaging machine comprising a transport device for the packing pieces, at least one unspooling device for unspooling the packing film wound onto a roller, a film cutting and welding device to at least partially cut said packing film at a wrapping location and to at least partially weld said packing film together after said packing film has been at least partially wrapped about one of said packing pieces, and a film buffer positioned between the film welding and cutting unit and the unspooling device, said packing film buffer designed to at least partially support said packing film that has accumulated between said second end and said first end, said packing film buffer at least partially formed of a flexible antistatic material that inhibits said packing film from adhering to said anti-static material as said packing film moves on said anti-static material.

37. The packaging machine as defined in claim 36, wherein said packing film buffer is non-planar.

38. The packaging machine as defined in claim 37, including a chute designed to guide said packing film as said packing film substantially freely moves downwardly from said roller onto said packing film buffer.

39. The packaging machine as defined in claim 38, wherein said film support includes a fabric or a non-woven material of anti-static threads or fibers.

40. The packaging machine as defined in claim 39, wherein said film support is at least partially secured with clamping ledges at the front end, back end or combinations thereof such that the front and back ends of said film support lie in a flow direction of said packing film.

41. The packaging machine as defined in claim 40, wherein said packing film is designed to cover at least one side of the packing pieces.

42. The packaging machine as defined in claim 41, wherein said packing film is formed a material that enables said packing film to be wrapped about the packing pieces with little or no tension applied to the packing pieces.

43. The packaging machine as defined in claim 36, including a chute designed to guide said packing film as said packing film substantially freely moves downwardly from said roller onto said packing film buffer.

44. The packaging machine as defined in claim 36, wherein said film support includes a fabric or a non-woven material of anti-static threads or fibers.

45. The packaging machine as defined in claim 44, wherein said film support includes linen cloth.

46. The packaging machine as defined in claim 36, wherein said film support is at least partially secured with clamping ledges at the front end, back end or combinations thereof such that the front and back ends of said film support lie in a flow direction of said packing film.

47. The packaging machine as defined in claim 36, wherein said packing film is designed to cover at least one side of the packing pieces.

48. The packaging machine as defined in claim 36, wherein said packing film is formed a material that enables said packing film to be wrapped about the packing pieces with little or no tension applied to the packing pieces.

* * * * *